US006390507B1

(12) United States Patent
Derraugh et al.

(10) Patent No.: US 6,390,507 B1
(45) Date of Patent: May 21, 2002

(54) SOFT BOOK

(76) Inventors: William Derraugh, 35 Rogues Ridge Rd., Weston, CT (US) 06883; Michael Morris, 78 Spoonwood Rd., Wilton, CT (US) 06897

( * ) Notice: Subject to any disclaimer, the term of this patent is extended or adjusted under 35 U.S.C. 154(b) by 0 days.

(21) Appl. No.: 09/886,161

(22) Filed: Jun. 20, 2001

(51) Int. Cl.[7] ..... B42D 1/00

(52) U.S. Cl. ..... 281/15.1; 281/21.1; 281/37; 281/38; 281/51; 283/63.1

(58) Field of Search ..... 281/15.1, 21.1, 281/22, 36, 37, 51; 283/63.1, 64

(56) References Cited

U.S. PATENT DOCUMENTS 5,954,518 A * 9/1999 Teichberg ..... 281/37 X
6,189,932 B1 * 2/2001 Kaufman ..... 281/37
6,213,669 B1 * 4/2001 Yamamoto ..... 281/37 X

* cited by examiner

*Primary Examiner*—Willmon Fridie, Jr.
(74) *Attorney, Agent, or Firm*—Tope-McKay & Associates

(57) ABSTRACT

A soft book comprised of foam pages bound by a book binding portion and a plurality of page binding portions is presented. A front cover page, a rear cover page, and at least one page, each page may which may have a perimeter, are provided, with the pages forming a spine portion, with the book bound such that a portion of the perimeter each page may extend beyond the binding portions to provide a soft perimeter for the book so that it is safe, particularly for children. The pages of the book may include impressions or cutouts that may be made in various shapes. Cutouts may provide a puzzle-type game for children. Various binding materials may be used, preferably chosen to provide sufficient support for the flexible foam pages.

17 Claims, 4 Drawing Sheets

SOFT BOOK

TECHNICAL FIELD

The present invention relates generally to books and more particularly to a book comprised of and bound by a flexible and supportive material.

BACKGROUND OF THE INVENTION

Reading materials in general, and books specifically, have existed for thousands of years. New materials have been developed since the time of papyrus and have been utilized in the construction and binding of reading materials. Books have traditionally been produced utilizing paper for the pages and thicker paper or cardboard for the covers. These materials can be extremely heavy, unwieldy, and in the case of children, can create the risk of injury due to lacerations and abrasions. Several patents have contemplated replacing these traditional materials with alternatives for both page and cover. U.S. Pat. No. 4,280,241 discloses a book construction technique in which the pages are constructed of cloth, and filled with plastic or rubber. While that patent discloses a book construction by surrounding soft rubber with a cloth material, a multitude of difficulties are presented. Cloth is a material with considerable limitations. These limitations are due in part from cloth's limited durability. Cloth must be sewn into or printed onto in order to create suitable reading material. Additionally, the construction technique required to construct the above book, mandated the use of sewing needles and thread.

A children's book comprised of foam leaves is disclosed in U.S. Pat. No. 6,070,909. While recognizing the benefits of foam construction, the '909 patent contemplates the absence of a cover material in order to create a book that is washable, and that may be used in a bathing environment. Additionally, the '909 patent contemplates the die cutting of foam parts from the leaves of the books as puzzle pieces. However, without additional support, foam is highly malleable and easily deformed due to changes in pressure or heat.

Therefore, a need exists in the art to provide a book suitable for small children which has pages constructed of a soft foam material, is bound with a flexible and supportive material, and is easily die cut.

SUMMARY OF THE PRESENT INVENTION

The present invention relates generally to books and more particularly to foam materials and methods for binding.

In one embodiment, the present invention provides a foam book comprising a front cover page having a perimeter and substantially comprised of foam and a rear cover page having a perimeter and substantially comprised of foam. Further, at least one page having a perimeter and residing between the front cover page and the rear cover page is provided, with the at least one page substantially comprised of foam; the front cover page, the rear cover page, and the at least one page together form pages of a foam book including a spine and a perimeter. Additionally, a book binding portion is provided, fixedly attached with and covering the spine of the foam book and a portion of the front cover page and the rear cover page such that a portion of the perimeter of the front cover page and the rear cover page may extend beyond the binding. The foam book further includes a plurality of page binding portions, with one page binding portion residing between each pair pages, attached with, and covering the pages such that a portion of the perimeter each of the pages extends beyond the page binding portion, with both the book binding portion and the page binding portions attached to allow the pages of the book to open and close; whereby the book binding portion and the plurality of page binding portions serve to bind all of the pages of the book together and allow for opening and closing the pages and whereby the perimeter of a portion of each of the pages may extend beyond the book binding portion and the page binding portions to provide a soft perimeter of the book.

In another embodiment, the book binding portion and page binding portions of the foam book are comprised of a flexible and supportive material.

In a still further embodiment of foam book, at least one shape is stamped into at least one of the book binding portion and page binding portions and into the foam of the pages covered thereby in order to form impression-type shapes in the pages.

In an additional embodiment, in foam book, the book binding portion and the page binding portions are comprised of a material selected from the group consisting of paperboard, laminated paperboard, plastic, and cloth.

In another embodiment, in the foam book, portions of at least one of the front cover page, the rear cover page, the at least one page therebetween, the book binding portion, and the page binding portions are cut partially or wholly through to form cut-out shapes therefrom. The cut-out shapes may be replaced into the portions of the at least one of the front cover page, the rear cover page, the at least one page therebetween, the book binding portion, and the page binding portions where they were cut from. The cut-out shapes may be formed in various shapes such as puzzle pieces.

In the foam book, the book binding portion and the page binding portions may be comprised of mutually different materials.

In another embodiment of the foam book, the foam book comprises a front cover page having a perimeter and substantially comprised of foam, a rear cover page having a perimeter and substantially comprised of foam, and at least one page having a perimeter and residing between the front cover page and the rear cover page, the at least one page substantially comprised of foam; the front cover page, the rear cover page, and the at least one page together forming pages of a foam book including a perimeter. Furthermore, a plurality of page binding portions are incorporated in the foam book, with one page binding portion residing between each pair pages, attached with, and covering the pages such that a portion of the perimeter each of the pages extends beyond the page binding portion, with page binding portions attached to allow the pages of the book to open and close; whereby the plurality of page binding portions serve to bind all of the pages of the book together and allow for opening and closing the pages and whereby the perimeter of a portion of each of the pages extends beyond the page binding portions to provide a soft perimeter of the book. The page binding portions in this embodiment are preferably comprised of a flexible and supportive material.

Furthermore, at least one shape may be stamped into at least one of the page binding portions and into the foam of the pages covered thereby in order to form impression-type shapes in the pages.

The page binding portions are generally comprised of a material selected from the group consisting of paperboard, laminated paperboard, plastic, and cloth.

In another embodiment, and in addition to the above features, in the foam book, portions of at least one of the front cover page, the rear cover page, the at least one page therebetween, and the page binding portions are cut partially or wholly through to form cut-out shapes therefrom. The cut-out shapes may be replaced into the portions of the at least one of the front cover page, the rear cover page, the at least one page therebetween, and the page binding portions where they were cut from. Additionally, the cut-out shapes are in the form of puzzle pieces. The page binding portions may be comprised of a material that forms an erasable writing surface.

These and other advantages of the present invention will be made more apparent with reference to the detailed description and the drawings provided herein.

DETAILED DESCRIPTION

Figure 1:
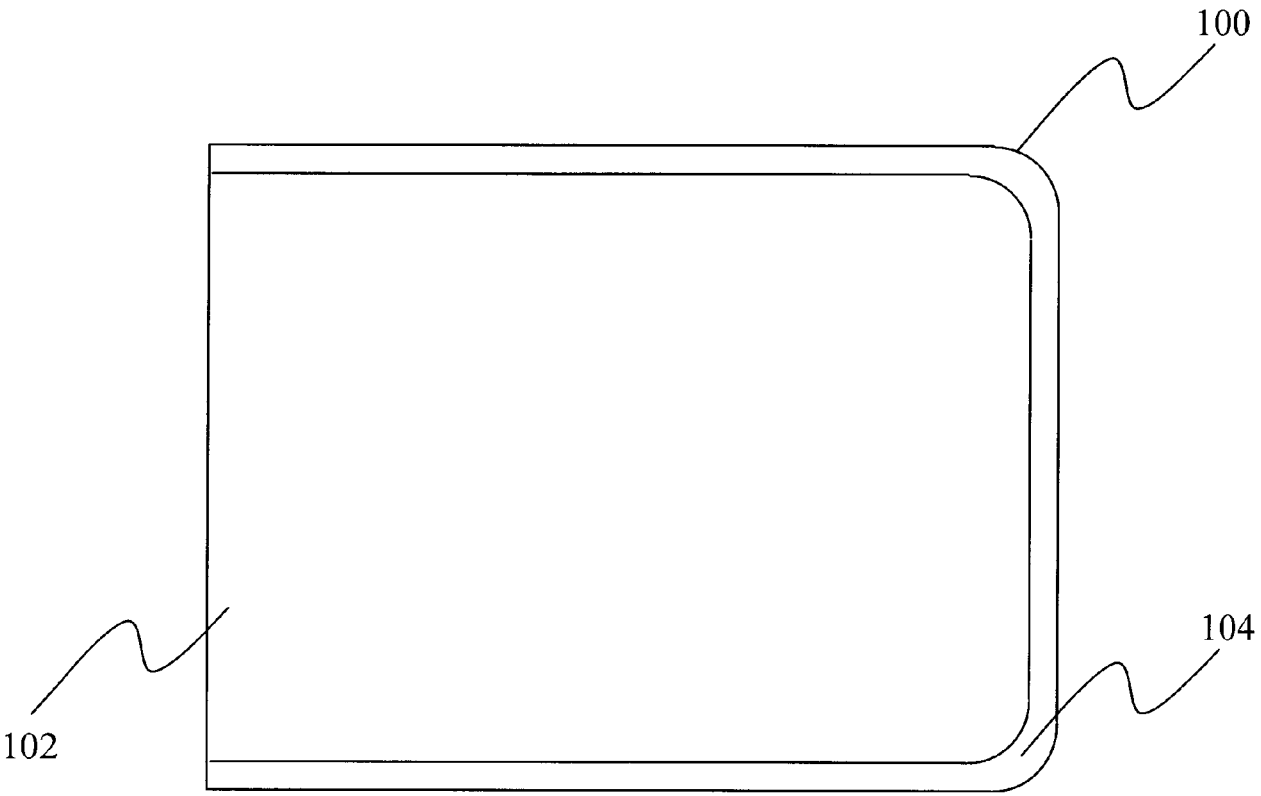
FIG. 1 is a frontal view of a soft book with front cover.

The present invention provides a book comprised of and bound by a flexible and supportive material which may be tailored to a variety of applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein The present invention presents a novel and useful soft book. An embodiment of the device of the present invention is presented in FIG. 1. A front cover 100 having a perimeter and substantially comprised of foam is shown, as well as a book-binding portion 102 fixedly attached to, and covering, a portion of the front cover 100, such that a portion of the perimeter 104 of the front cover 100 page extends beyond the binding 102.

The book binding portion 102 is comprised of a flexible and supportive material. Nonlimiting examples of binding materials include paperboard, laminated paperboard, plastic, and cloth.

The front cover 100 is comprised of a foam material, which provides rigidity, printability and usability. In the preferred embodiment, all foam utilized in the present invention will be ethyl vinyl acetate (EVA). EVA as a material is soft, very easily manufactured into various shapes and thickness, as well as rugged and sturdy making it a good material for children's books whose pages are easily ripped.

Figure 2:
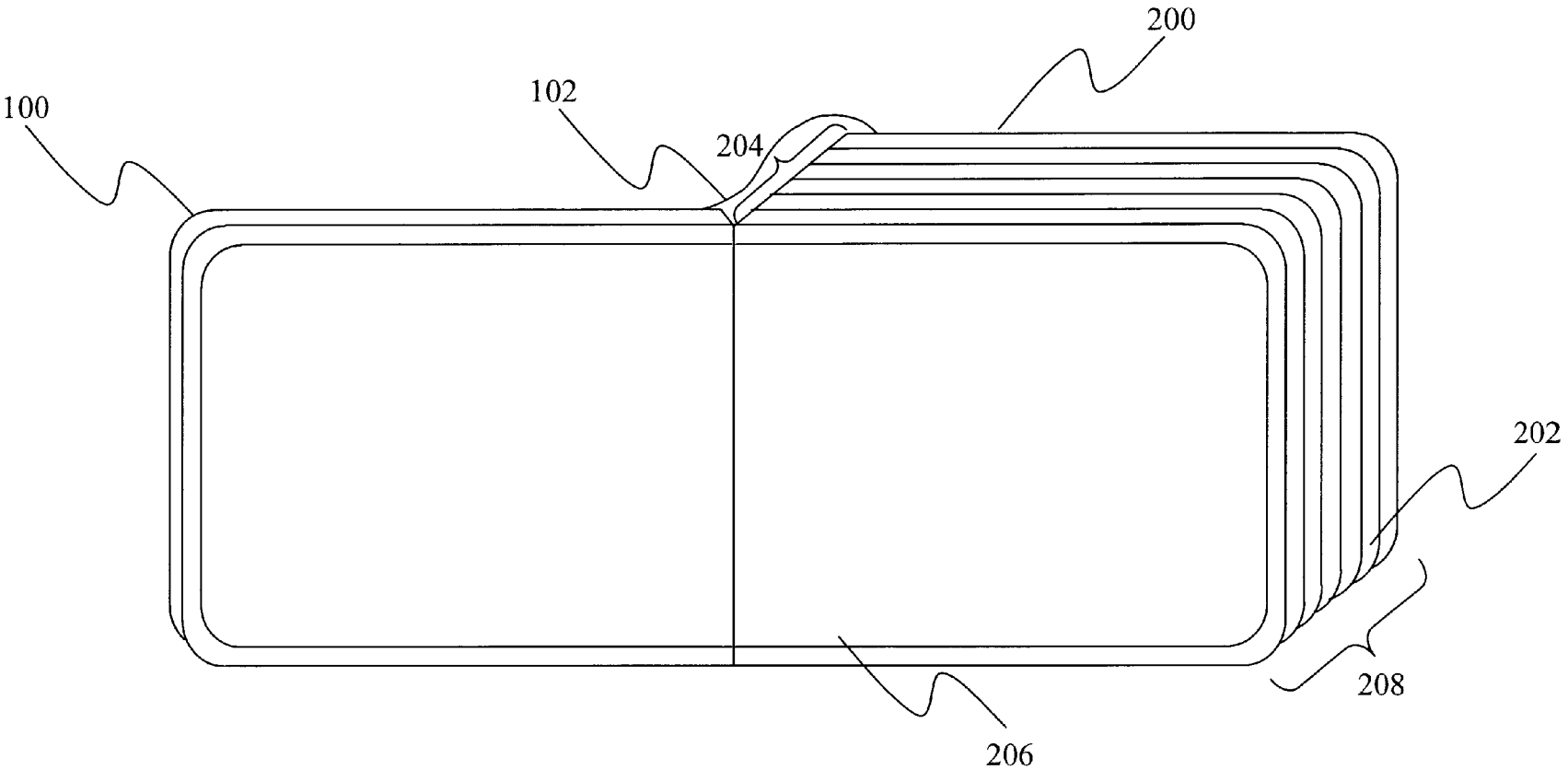
FIG. 2 is an open side view of the soft book in accordance with the present invention.

An open side view of the soft book is shown in FIG. 2. As can be seen in FIG. 2, the front cover 100 is open hingedly and the book binding portion 102 is fixedly attached thereto. A foam page 202 is shown, where an edge of a set of multiple pages comprises a spine 204, which is covered by the book binding portion 102. The book binding portion 102 is fixedly attached to both the front cover 100 and a rear cover 200. The book binding portions 102, and the page binding portions 206, may be attached by one of many means, non-limiting examples of which include glue, resin, paste and adhesives. The outermost portion of each page 202, not covered by a page binding portions 206 or the book binding portions 102, comprise a soft perimeter 208. The foam pages 202 are fixedly attached to each other foam page 202 by the page binding portion 206. A plurality of the page binding portions 206, with one page binding portion 206 residing between each pair of pages 202, attach with, and covering the pages 202 such that a portion of the perimeter each of the pages extends beyond the page binding portion 206.

Both the book binding portion 102 and the page binding portions 206 attach to allow the pages 202 of the book to open and close, whereby the book binding portion 102 and the plurality of page binding portions 206 serve to bind all of the pages 102 of the book together and allow for opening and closing the pages 202. The perimeter of a portion of each of the pages 202 extends beyond the book binding portion 102 and the page binding portions 206 to provide a soft perimeter of the book. The page binding portions 206 are comprised of a flexible and supportive material, non-limiting examples of which include paperboard, laminated paperboard, plastic, and cloth.

Figure 3:
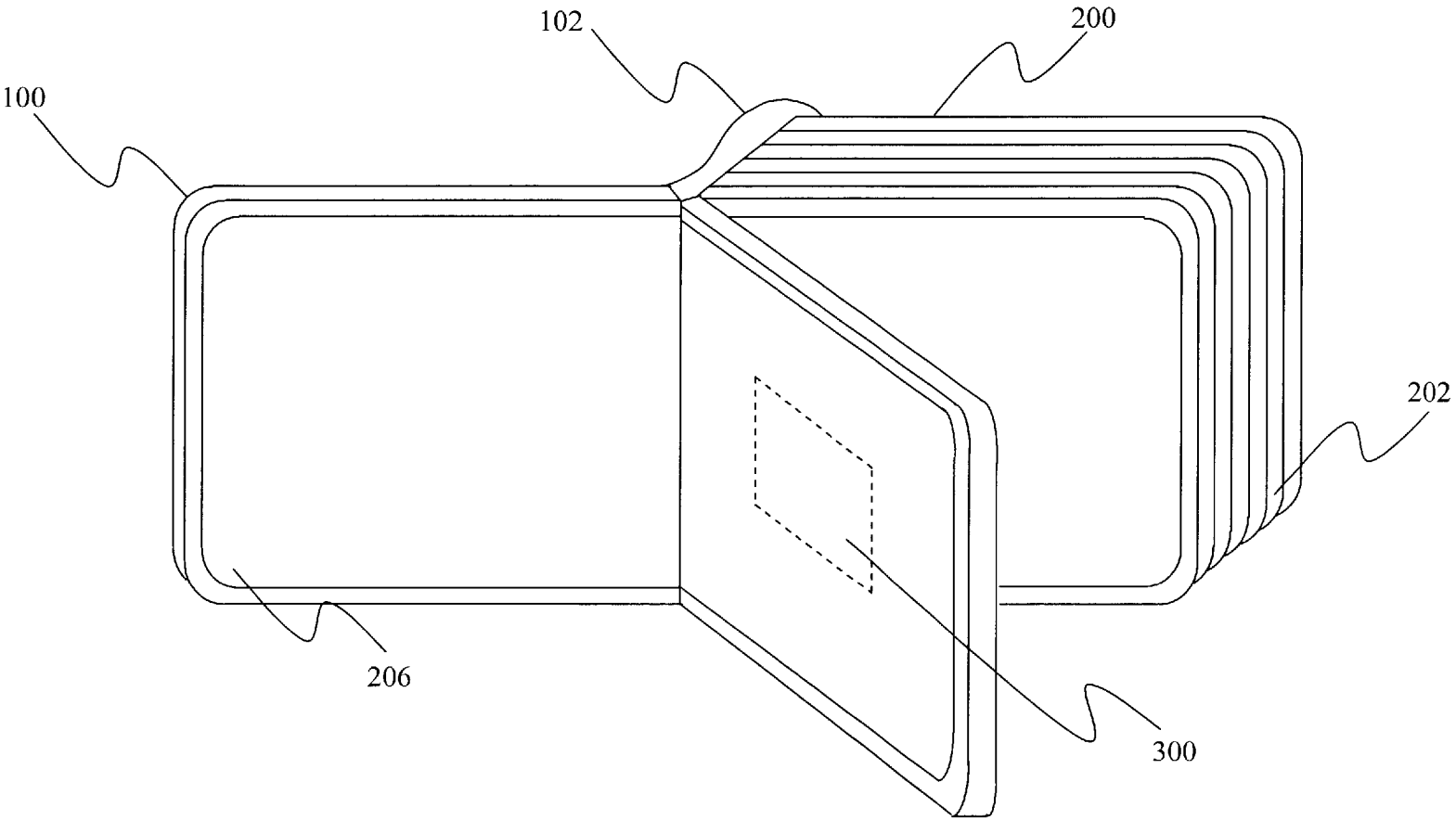
FIG. 3 is an open side view of soft book and die impressed page.

An open side view of soft book and die cut page is shown in FIG. 3. As can be seen in FIG. 3, a shape 300 is impressed into the page 202. The shape 300 can be impressed or stamped to varying depths and for varying purposes non-limiting examples of which include words, shapes, and pictures.

Figure 4:
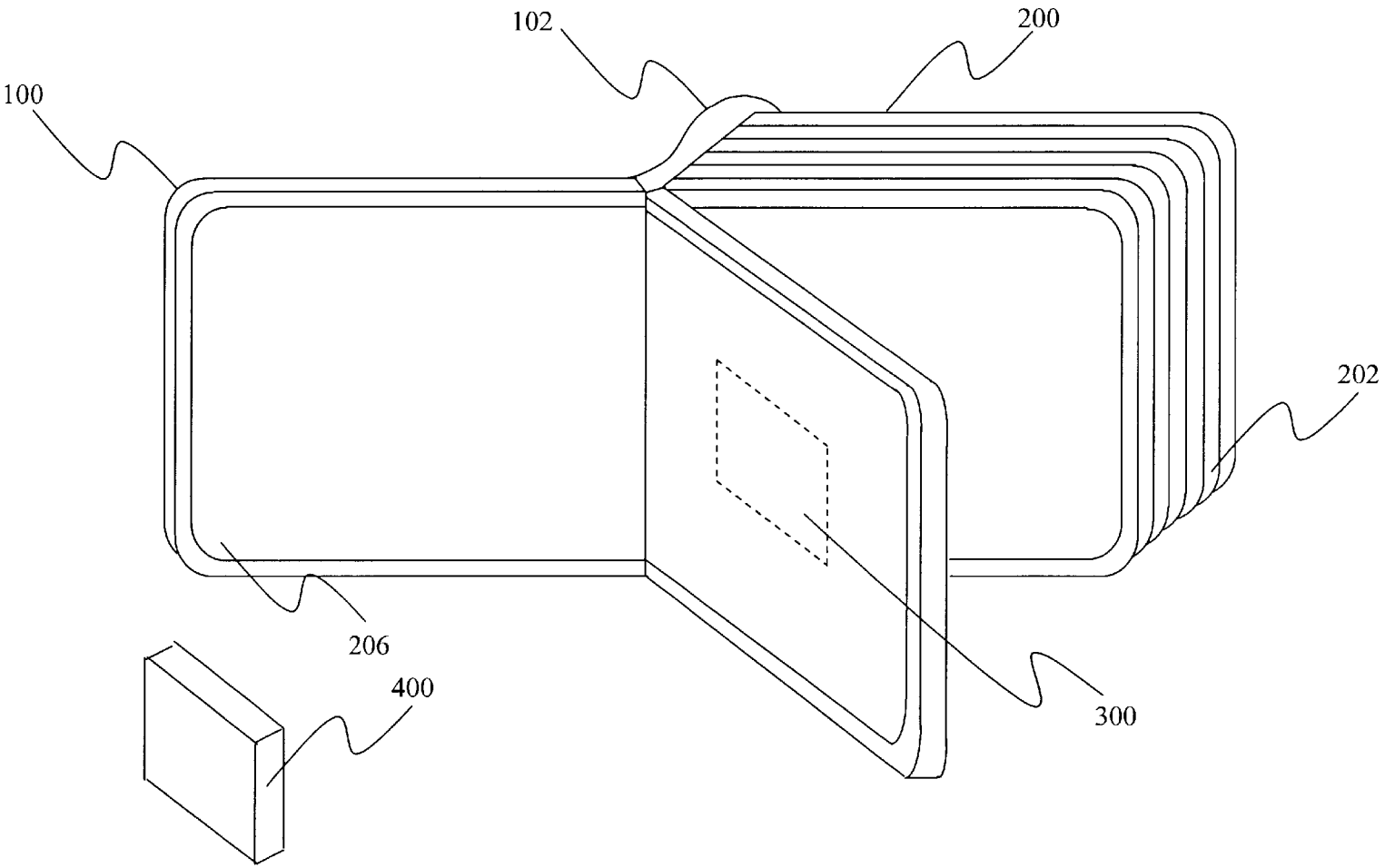
FIG. 4 is an open side view of the soft book and die-cut page with the die-cut piece removed in accordance with the present invention.

A rear view of the present invention is shown in FIG. 4. As can be seen in FIG. 4, the page portion 202 and the page binding portion 206 can be cut wholly through to form a cut-out shape 400. The cut-out shapes 400 may optionally be replaced into the portions of a page 202 where they are cut from. The cut-out shapes 400 can be cut in varying sizes, and may, for example, be cut in the shape of puzzle pieces. Due to the cut-out shapes 400 being cut from both the foam material that comprises the pages 202 and the flexible and supportive material that comprises the page binding portions 206, and the book binding portions 102, the cut-out shapes are sturdy and flexible.

Additionally, the book binding portion 102 and the page binding portion 206 may be composed of differing materials. Although the preferred embodiment includes both book binding portions 102 and page binding portions 206, the book binding portion 102 may be omitted where the page binding portions provide adequately for the pages to remain attached.

What is claimed is:

1. A foam book comprising:

a. a front cover page having a perimeter and substantially comprised of foam;

b. a rear cover page having a perimeter and substantially comprised of foam;

c. at least one page having a perimeter and residing between the front cover page and the rear cover page, the at least one page substantially comprised of foam; the front cover page, the rear cover page, and the at least one page together forming pages of a foam book including a spine and a perimeter;

d. a book binding portion fixedly attached with and covering the spine of the foam book and a portion of the front cover page and the rear cover page such that a portion of the perimeter of the front cover page and the rear cover page extend beyond the binding; and e. a plurality of page binding portions, with one page binding portion residing between each pair pages, attached with, and covering the pages such that a portion of the perimeter each of the pages may extend beyond the page binding portion, with both the book binding portion and the page binding portions attached to allow the pages of the book to open and close; whereby the book binding portion and the plurality of page binding portions serve to bind all of the pages of the book together and allow for opening and closing the pages and whereby the perimeter of a portion of each of the pages may extend beyond the book binding portion and the page binding portions to provide a soft perimeter of the book.

2. A foam book as set forth in claim 1, wherein the book binding portion and the page binding portions are comprised of a flexible and supportive material.

3. A foam book as set forth in claim 2, wherein at least one shape is stamped into at least one of the book binding portion and page binding portions and into the foam of the pages covered thereby in order to form impression-type shapes in the pages.

4. A foam book as set forth in claim 2, wherein the book binding portion and the page binding portions are comprised of a material selected from the group consisting of paperboard, laminated paperboard, plastic, and cloth.

5. A foam book as set forth in claim 4, wherein portions of at least one of the front cover page, the rear cover page, the at least one page therebetween, the book binding portion, and the page binding portions are cut partially or wholly through to form cut-out shapes therefrom.

6. A foam book as set forth in claim 5, wherein the cut-out shapes may be replaced into the portions of the at least one of the front cover page, the rear cover page, the at least one page therebetween, the book binding portion, and the page binding portions where they were cut from.

7. A foam book as set forth in claim 6, wherein the cut-out shapes are in the form of puzzle pieces.

8. A foam book as set forth in claim 1, wherein at least one of the book binding portion and the page binding portions are comprised of a material that forms an erasable writing surface.

9. A foam book as set forth in claim 1, wherein the book binding portion and the page binding portions are comprised of mutually different materials.

10. A foam book comprising:

a. a front cover page having a perimeter and substantially comprised of foam;

b. a rear cover page having a perimeter and substantially comprised of foam;

c. at least one page having a perimeter and residing between the front cover page and the rear cover page, the at least one page substantially comprised of foam; the front cover page, the rear cover page, and the at least one page together forming pages of a foam book including a perimeter; and d. a plurality of page binding portions, with one page binding portion residing between each pair pages, attached with, and covering the pages such that a portion of the perimeter each of the pages may extend beyond the page binding portion, with page binding portions attached to allow the pages of the book to open and close; whereby the plurality of page binding portions serve to bind all of the pages of the book together and allow for opening and closing the pages and whereby the perimeter of a portion of each of the pages may extend beyond the page binding portions to provide a soft perimeter of the book.

11. A foam book as set forth in claim 10, wherein the page binding portions are comprised of a flexible and supportive material.

12. A foam book as set forth in claim 11, wherein at least one shape is stamped into at least one of the page binding portions and into the foam of the pages covered thereby in order to form impression-type shapes in the pages.

13. A foam book as set forth in claim 11, wherein the page binding portions are comprised of a material selected from the group consisting of paperboard, laminated paperboard, plastic, and cloth.

14. A foam book as set forth in claim 13, wherein portions of at least one of the front cover page, the rear cover page, the at least one page therebetween, and the page binding portions are cut partially or wholly through to form cut-out shapes therefrom.

15. A foam book as set forth in claim 14, wherein the cut-out shapes may be replaced into the portions of the at least one of the front cover page, the rear cover page, the at least one page therebetween, and the page binding portions where they were cut from.

16. A foam book as set forth in claim 15, wherein the cut-out shapes are in the form of puzzle pieces.

17. A foam book as set forth in claim 10, wherein at least one of the page binding portions is comprised of a material that forms an erasable writing surface.

* * * * *